US007777146B2

(12) United States Patent
Jones

(10) Patent No.: US 7,777,146 B2
(45) Date of Patent: Aug. 17, 2010

(54) SAFETY SWITCH

(75) Inventor: Derek Jones, Gallowway (GB)

(73) Assignee: Rockwell Automation Limited, Milton Keynes (GB)

( * ) Notice: Subject to any disclaimer, the term of this patent is extended or adjusted under 35 U.S.C. 154(b) by 746 days.

(21) Appl. No.: 11/684,325

(22) Filed: Mar. 9, 2007

(65) Prior Publication Data

US 2007/0227869 A1 Oct. 4, 2007

(30) Foreign Application Priority Data

Mar. 28, 2006 (GB) ..... 0606154.3

(51) Int. Cl.
*H01H 9/20* (2006.01)

(52) U.S. Cl. ..... 200/334

(58) Field of Classification Search ..... 200/334, 200/505, 1 B

See application file for complete search history.

(56) References Cited

U.S. PATENT DOCUMENTS 2,947,840 A 8/1960 Park et al.
4,376,877 A * 3/1983 Decker ..... 200/1 B

FOREIGN PATENT DOCUMENTS

DE 8812349 7/1989
DE 19615682 10/1997
EP 0361241 4/1990
EP 0927611 7/1999
EP 1365429 11/2003

OTHER PUBLICATIONS

European Extended Search Report, Application No. EP 07251230, dated Dec. 29, 2008.

* cited by examiner

*Primary Examiner*—Ross N Gushi
(74) *Attorney, Agent, or Firm*—Boyle Fredrickson LLP; William R. Walbrun; John M. Miller

(57) ABSTRACT

A safety switch assembly having a handle pivotably attached to a casing to allow selective operation of an electrical contact assembly. The handle is attached to the casing with a movable pivot such that excessive grip pressure renders the safety switch inoperable until the safety switch is reset. The handle is moveable responsive to grip pressures that range from no actuation to a first grip pressure. Actuation of the handle in this range controls operation of the electrical contact assembly. Gripping of the switch with a grip pressure greater than the first grip pressure moves the pivot such that the safety switch is rendered inoperable, or non-conductive, until manipulation of a reset actuator returns the pivot to a pivot position associated with the first operating zone. Such a construction provides a safety switch that can be rendered inoperable and reset to allow subsequent operation.

19 Claims, 5 Drawing Sheets

SAFETY SWITCH

CROSS-REFERENCE TO RELATED APPLICATIONS

This application is a United States patent application that claims priority to Great Britain Patent Application number 0606154.3 filed Mar. 28, 2006, the disclosure of which is incorporated herein.

BACKGROUND OF THE INVENTION

The present invention relates to a safety switch.

In a variety of environments, including for example industrial environments, there is a need for systems that are capable of preventing access to one or more pieces of equipment or machinery whilst that equipment or machinery is operating, in a manner that is highly reliable. In some circumstances, this may be achieved by the use of a safety switch.

Electrically operated machinery, for example, may be located within an enclosure. The enclosure may be a room, a cage, a specific area etc. When a person enters the enclosure, for example by opening a gate, the safety switch disconnects, grounds or otherwise isolates the electrical machinery from one or more power sources in a predictable, reliable manner. Thus, when a user enters the enclosure the chances of him/her suffering injury from the machinery are reduced or eliminated. In some circumstances, the machinery is not able to be restarted until the user has left the enclosure and reset the safety switch. While this is a useful safety feature, it is not very flexible.

In some circumstances it is conceivable that the user, while inside the enclosure, may still require the machinery to be operating in, for example a special mode (e.g. low speed or incremental movement mode), or, at the very least have control over its operation. For example, the user may wish to have electrical power maintained to the machinery within the enclosure so that he may test the equipment or clean the equipment. If the equipment within the enclosure is of a robotic nature, the user may wish to maintain power to the equipment so that he may teach the robot what to do. In this case, the robot must have some power to learn.

With prior art safety switches and enclosures, power is in general not supplied to the equipment while a user is in the enclosure. However, safety switches are known which do allow the supply of electrical power to machinery when in the enclosure. The safety switch is connected to the machinery and operable from within the enclosure. An example of such a safety switch has a handle moveable to three positions. In the first position, where no pressure is applied to the handle, the switch does not conduct electricity and no power is supplied to the machinery. When a certain amount of pressure is applied to the handle, electrical contacts within the switch are closed and the switch conducts electricity so that power is supplied to the machinery. If the handle is depressed further, for example due to the user reacting to a dangerous situation, the supply of electrical power to the machinery is cut-off and is not restored until the handle is moved to the second position.

Thus, it is an object of the present invention to provide a novel safety switch.

BRIEF DESCRIPTION OF THE INVENTION

According to a first aspect of the present invention there is provided a safety switch having a body; at least one electrical component for controlling the conduction of electricity by the safety switch; and a handle pivotably attached to the body and pivotable about a pivot point. The handle is pivotable between a first operating zone, a second operating zone and a third operating zone. The first operating zone corresponds to a situation where the handle is not depressed and the electrical component is arranged such that the safety switch cannot conduct electricity. The second operating zone corresponds to a situation where the handle is depressed to a first extent and the electrical component is arranged such that the safety switch is able to conduct electricity. The third operating zone corresponds to the situation where the handle is depressed to a further, second extent, and the electrical component is arranged such that the safety switch cannot conduct electricity, wherein the pivot point is moveable from a first position to a second position when the handle is depressed to the third operating zone, the second position of the pivot point being arranged such that the electrical component is arranged such that the safety switch cannot conduct electricity, irrespective of whether the handle is subsequently moved to the first or second operating zones.

According to a second aspect of the present invention, there is provided a powered piece of equipment and a safety switch arranged to allow the control of the supply of power to the equipment. The safety switch comprising a body, at least one electrical component for controlling the conduction of electricity by the safety switch, and a handle pivotably attached to the body and pivotable about a pivot point. The handle is pivotable between a first operating zone, a second operating zone and a third operating zone. The first operating zone corresponds to a situation where the handle is not depressed and the electrical component is arranged, such that the safety switch cannot conduct electricity. The second operating zone corresponds to a situation where the handle is depressed to a first extent and the electrical component is arranged such that the safety switch is able to conduct electricity. The third operating zone corresponds to the situation where the handle is depressed to a further, second extent, and the electrical component is arranged such that the safety switch cannot conduct electricity. The pivot point is moveable from a first position to a second position when the handle is depressed to the third operating zone. The second position of the pivot point is arranged such that the electrical component is arranged such that the safety switch cannot conduct electricity, irrespective of whether the handle is subsequently moved to the first or second operating zones.

According to a third aspect of the present invention, there is provided a safety switch comprising: a body; at least one electrical component for controlling the conduction of electricity by the safety switch; and a handle attached to the body. The handle is moveable between a first operating zone, a second operating zone, and a third operating zone wherein the first operating zone corresponds to a situation where the handle is not depressed and the electrical component is arranged such that the safety switch cannot conduct electricity. The second operating zone corresponds to a situation where the handle is depressed to a first extent and the electrical component is arranged such that the safety switch is able to conduct electricity and the third operating zone corresponds to the situation where the handle is depressed to a further, second extent, and the electrical component is arranged such that the safety switch cannot conduct electricity. The safety switch further comprises a reset actuator which is arranged such that upon moving the handle to the third operating zone, the electrical component is maintained in an arrangement such that the safety switch cannot conduct electricity, until the reset actuator has been activated.

The safety switch has the advantage that it avoids power accidentally being provided to machinery by a user unintentionally moving the handle to the second operating zone (for example if the user relaxes his or her grip on the safety switch) after reacting to a dangerous situation and moving the handle to the third operating zone (for example if the user is startled).

BRIEF DESCRIPTION OF THE DRAWINGS

Embodiments of the present invention will now be described, by way of example only, with reference to the accompanying figures, in which.

DETAILED DESCRIPTION OF THE PREFERRED EMBODIMENTS

Figure 1:
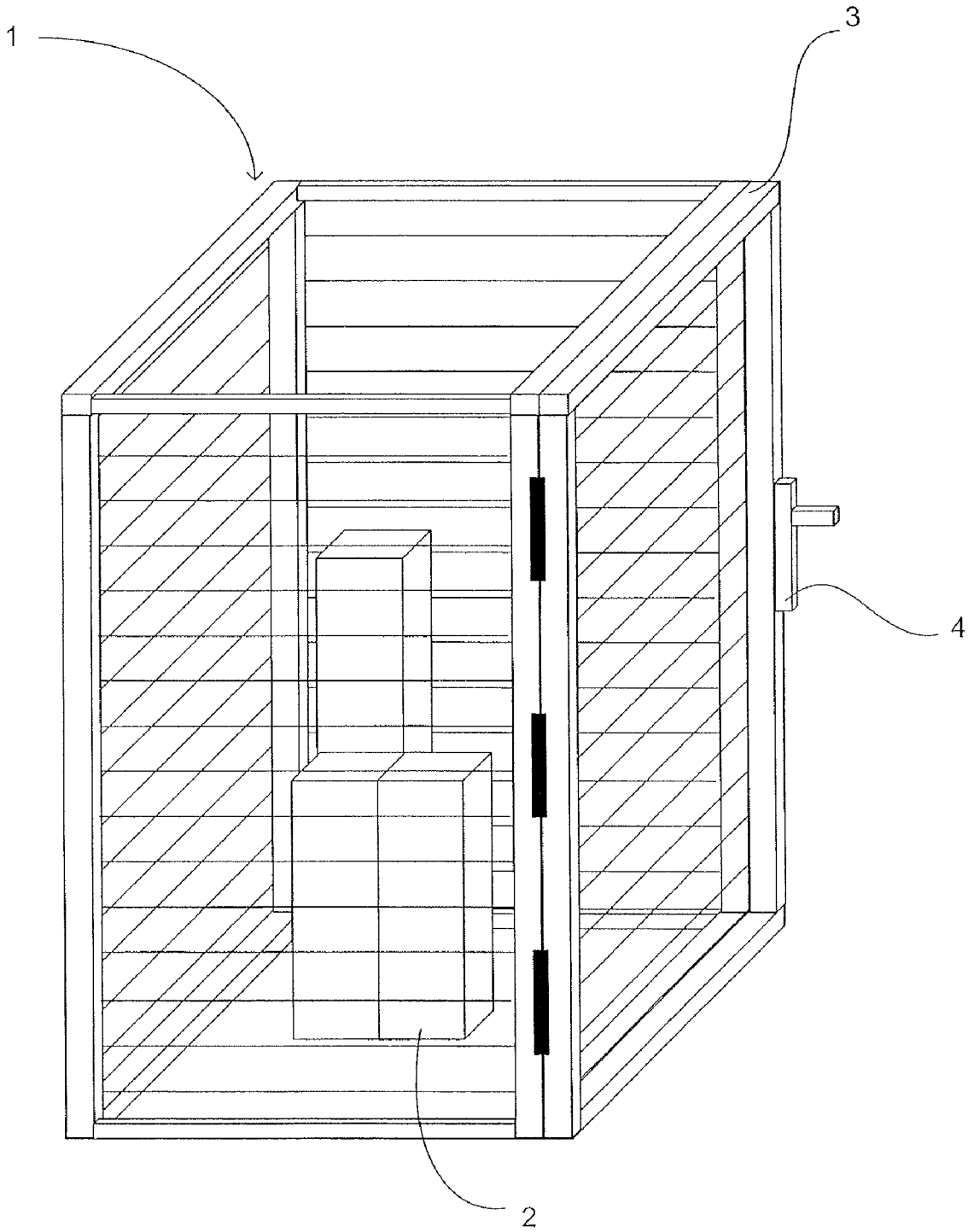
FIG. 1 is a schematic representation of an enclosure equipped with a safety switch according to the present invention.

FIG. 1 shows a perspective view of an enclosure 1 that encloses electrically operated machinery 2. Access to the enclosure 1 is gained via a gate 3, which is provided with a safety switch 4. To open the gate 3, the safety switch 4 must be activated. By activating the safety switch 4, the supply of electrical power to the machinery 2 is interrupted. Electrical power to the machinery 2 can only be re-established by the user leaving the enclosure 1 and re-setting the safety switch 4.

It will be appreciated that different safety switches, or different operating principles for a given safety switch may be used. For example, opening the gate 3 may automatically cut the power supply, negating the need to consciously activate the switch 4. Alternatively, the gate 3 may only be opened, and the power to the machinery 2 cut off, when an actuator (e.g. a key) is inserted into the safety switch 4. The safety switch 4 could even comprise a light gate, whereby when a beam of light is broken the power to the machinery 2 is cut-off.

It may be desirable to supply power to the machinery 2 even when the user is in the enclosure 1. However, if a simple on-off switch is provided, the safety measures provided by the safety switch 4 are circumvented, which re-introduces the possibility of the user suffering injury from the machinery 2.

Figure 2A:
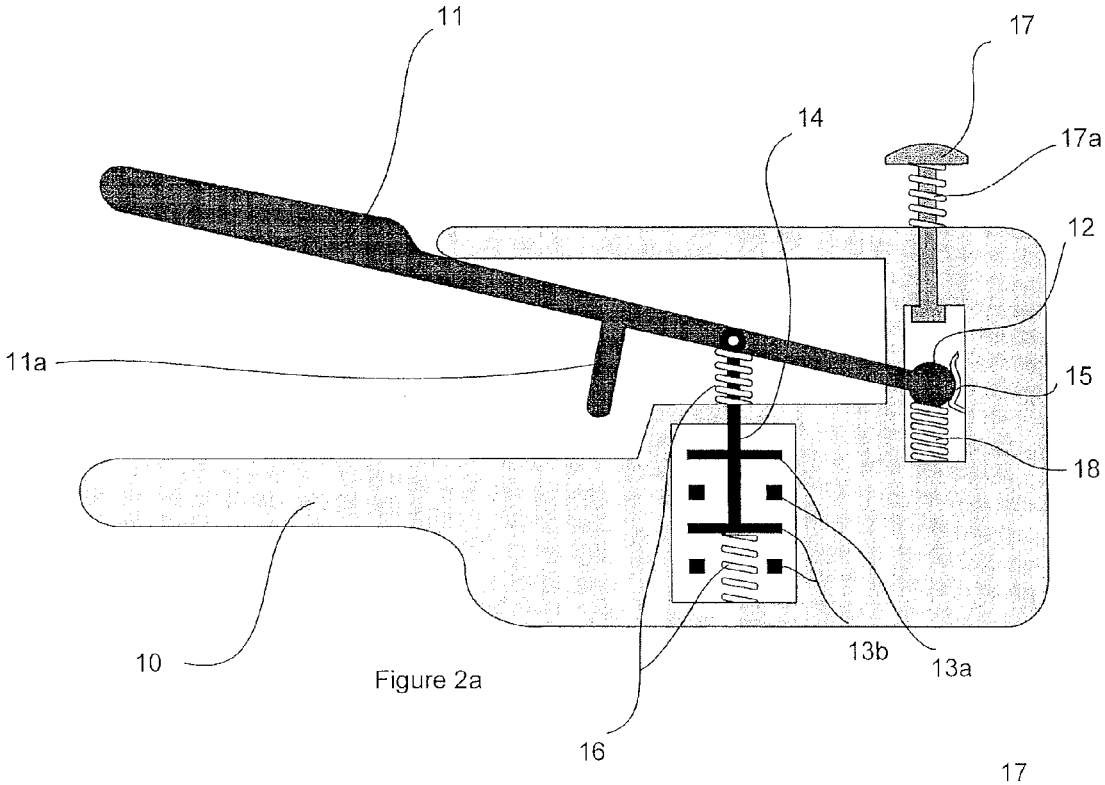
FIGS. 2*a* to 2*g* depict a safety switch according to an embodiment of the present invention.

FIG. 2*a* illustrates a safety switch in accordance with an embodiment of the present invention. The safety switch comprises a casing 10, in which is pivotally mounted a handle 11. The handle 11 is free to pivot about a moveable pivot point 12. The handle 11 is connected to a set of contacts 13*a*, 13*b* by way of a post 14.

FIG. 2*a* shows the handle 11 with no force applied by a user (not shown), i.e. the handle 11 is in a first operating zone. While in the first operating zone, the pivot point 12 is maintained in position by a biasing member 15. Springs 16 located about the post 14 and contacts 13*a*, 13*b* keep the handle 11 in the first operating zone when no force is applied by the user, whereby the contacts 13*a*, 13*b* are kept open so that no electrical power can flow through the switch. The handle 11 is provided with a fulcrum 11*a* which extends perpendicular to the length of the handle 11. The safety switch is also provided with a reset actuator 17, which is biased by a spring 17*a*, and a further spring 18, the significances of which are described in more detail later.

The safety switch may be formed using any suitable materials. For example, the handle 11 and casing 10 of the safety switch can be formed from a durable plastic, or any material that can electrically insulate the contacts 13*a*, 13*b* from the user.

The safety switch of the present invention differs from those of the prior art in that the pivot point 12 of the safety switch of the present invention is moveable, and that the safety switch of the present invention is provided with a reset actuator 17.

In use, the contacts 13*a*, 13*b* may be connected between a power supply and equipment to be powered by the power supply (not shown in the figures). The safety switch itself may be carried around by the user while in an enclosure.

Figure 2B:
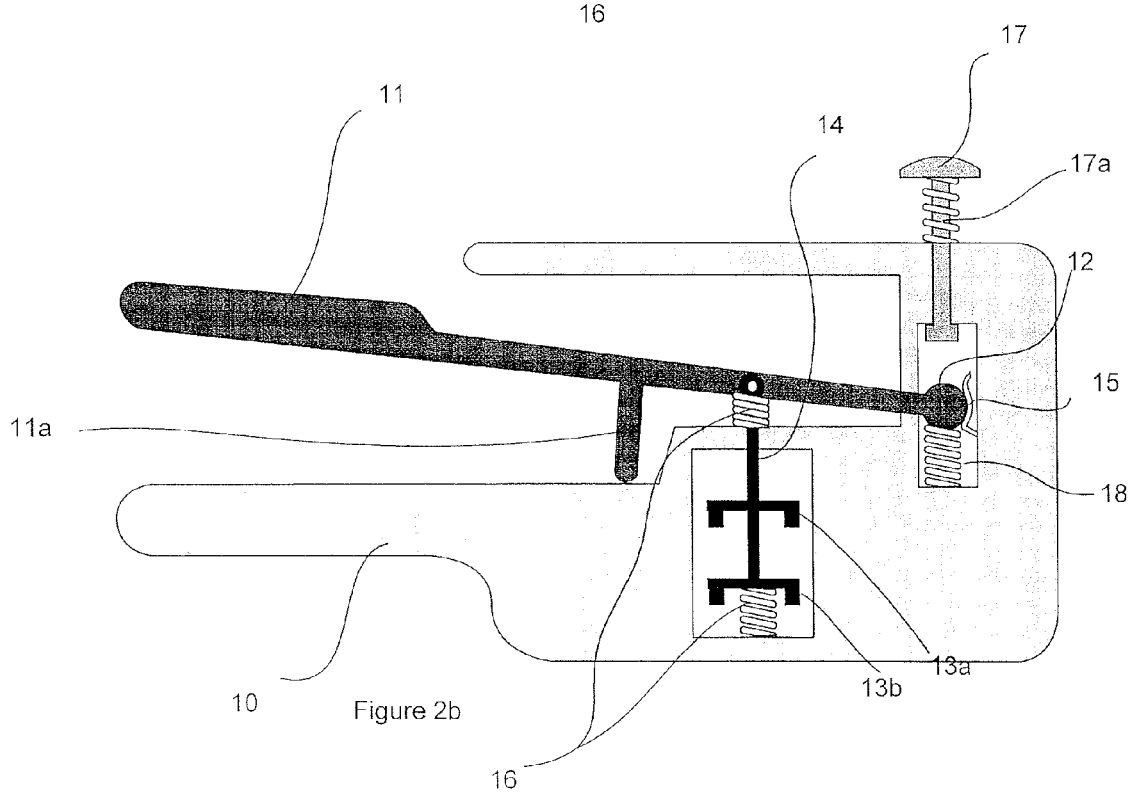

FIG. 2*b* illustrates the safety switch when the handle 11 has been depressed to such an extent as to close the electrical contacts 13*a* and 13*b* such that electrical power may be supplied to the machinery. When the handle 11 is in this position, it is in a second operating zone, i.e. the safety switch is able to conduct electricity. It can be seen that the pivot point 12 has not changed position, and that it is still held in position by the biasing member 15. The fulcrum 11 a makes contact with a surface of the casing 10 when the handle 11 is in the second operating zone.

If the user reduces the pressure applied to the handle 11 (for example, by dropping the safety switch), the handle 11 will be pushed from the second operating zone to the first operating zone by the springs 16. At the same time, the electrical contacts 13*a*, 13*b* are opened such that the supply of electrical power to the machinery is interrupted. Thus, if the user of the safety switch loses grip on the handle 11 (for example due to an incident involving the machinery), power to the machinery will be cut-off so that the chance of injury to the user is reduced.

Instead of the user of the safety switch losing grip of or dropping the safety switch, it is possible that due to a reaction to a dangerous situation the user may actually increase his/her grip on the safety switch and handle 11. If the pressure on the handle 11 exceeds a predetermined amount, it is desirable that power to the machinery is cut off. For example, if the user is startled, it may be safer to cut off power to the machinery than to have a startled user in close proximity to dangerous machinery in operation. This safety measure is particularly important if the user is electrocuted, because a sudden increase in grip is associated with electrocution. If the machinery on which the user is operating causes the user to be electrocuted, the user's grip on the safety switch will increase and cut-off the supply of electricity to the machinery.

Figure 2C:
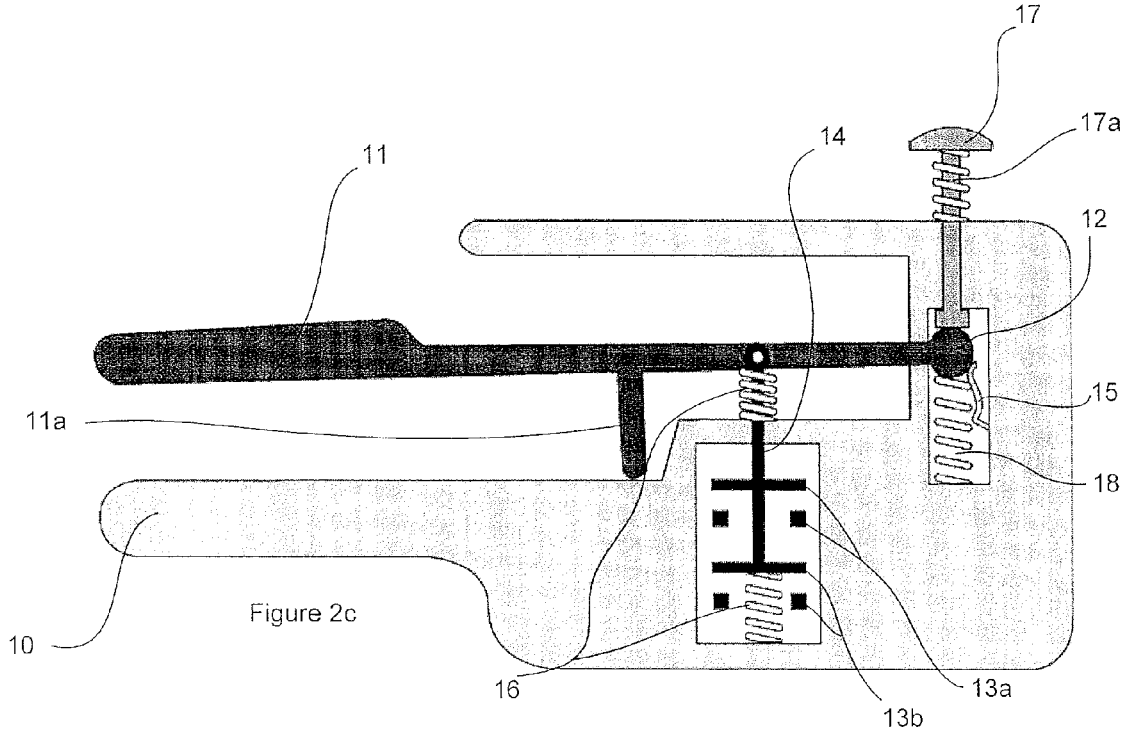

FIG. 2*c* illustrates the handle 11 in a third operating zone, whereby the pressure applied to the handle 11 is greater than that illustrated in FIG. 2*b*. It can be seen that since the fulcrum 11*a* is now in contact with an inner surface of the casing 10, the handle 11 now pivots about the fulcrum 11*a*. It can be seen that the pivot point 12 about which the handle 11 pivots in FIGS. 2*a* and 2*b* (i.e. when the handle 11 is in the first or second operating zone) has now moved, since the force applied to the handle 11 has caused the pivot point 12 to overcome the biasing member 15. In overcoming the biasing member 15, the pivot point 12 has moved from a first position to a second position. As the pivot point 12 has moved, so has the post 14 which is connected to the contacts 13*a*, 13*b*. Consequently, the contacts 13*a*, 13*b* are opened. The pivot point 12 is kept in the second position by the further spring 18.

Figure 2D:
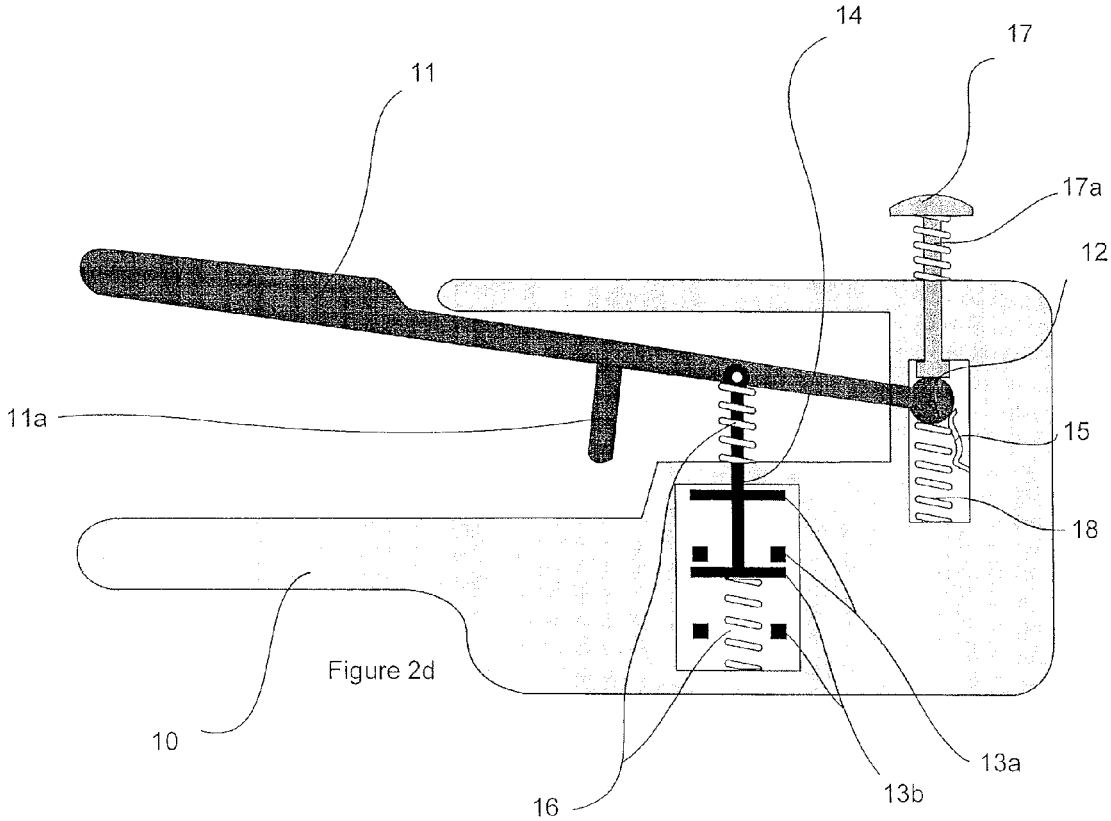
Figure 2E:
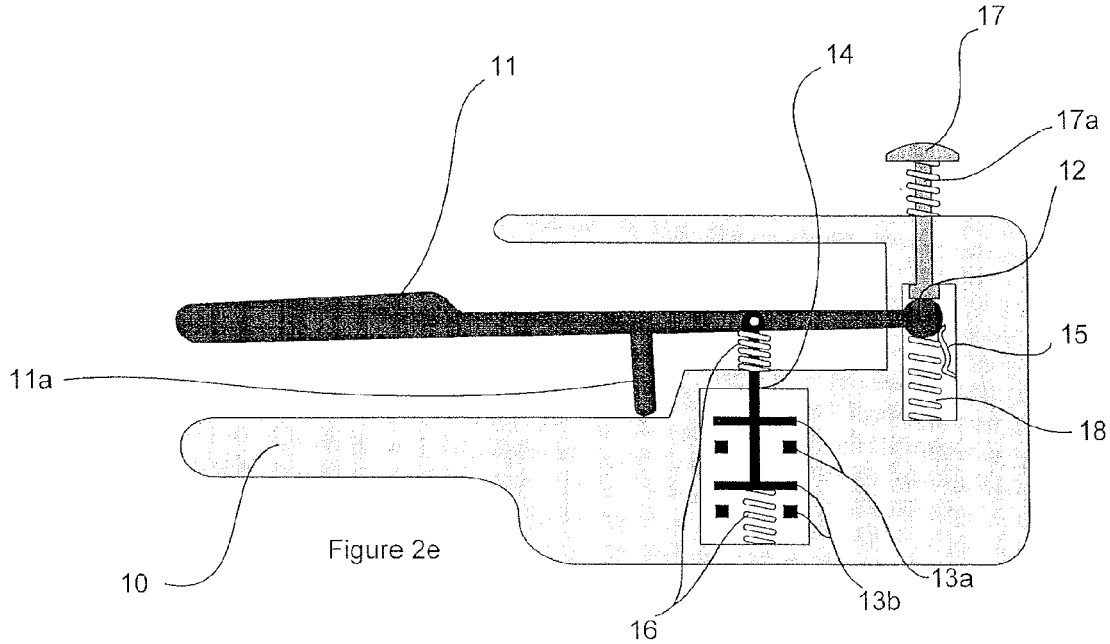

It can be seen from FIG. 2*d* that when the handle 11 is released and returned to the first operating zone by the springs 16, the electrical contacts 13*a*, 13*b* remain open. The electrical contacts 13*a*, 13*b* remain open even when the handle 11 is depressed until the fulcrum 11*a* once again comes into contact with the surface of the casing 10, as illustrated in FIG. 2*e*.

Figure 2F:
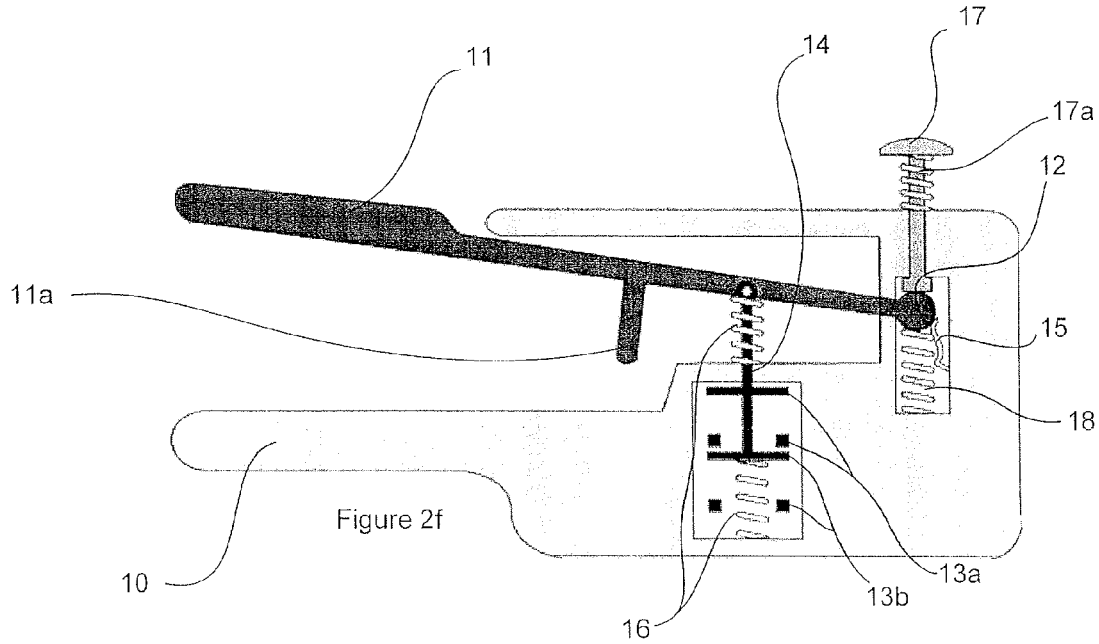

FIG. 2*f* corresponds to FIG. 2*d*, and illustrates that after the handle has been moved to the third operating zone, so that the pivot point 12 moves and the electrical contacts 13*a* and 13*b* are opened, electrical power cannot be supplied to the machinery simply by moving the handle 11. The contacts 13*a*, 13*b* can only be closed, and electrical power restored to the machinery by activation of the reset actuator 17, which will move the pivot point 12 back to its original position.

Figure 2G:
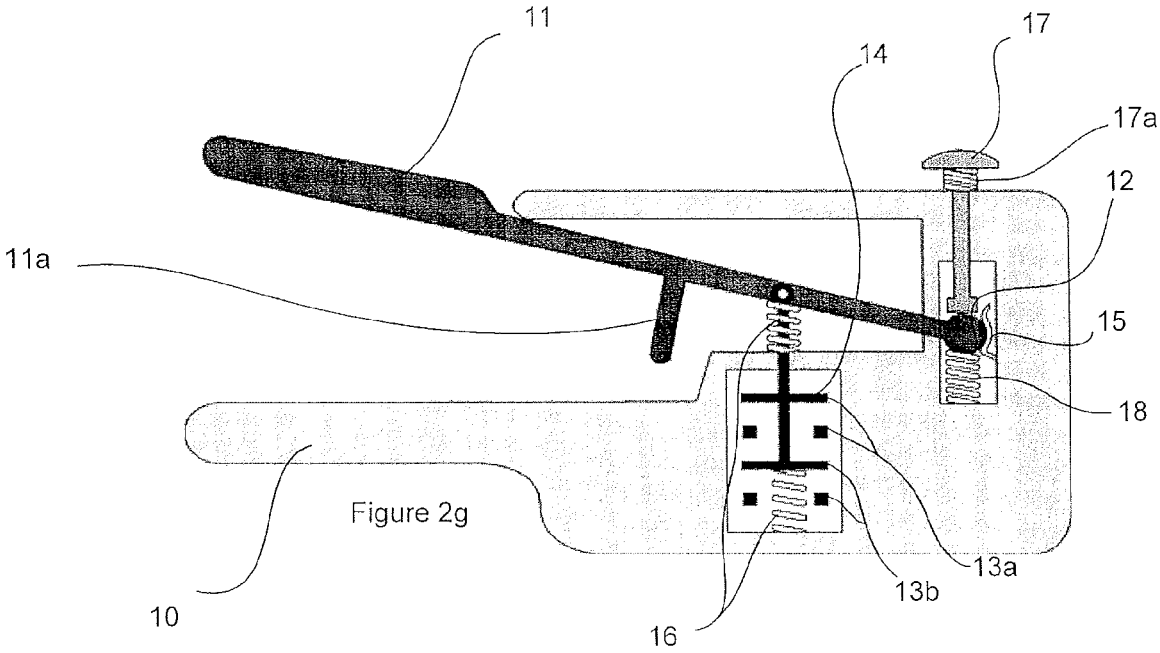

FIG. 2*g* shows that in order to reset the safety switch, the reset actuator 17 is depressed. The reset actuator 17 pushes the pivot point 12 against the further spring 18, and moves the pivot point 12 from the pivot point's second position to the pivot point's first (and initial) position. When pressure is removed from the reset actuator 17 the spring 17*a* pushes the reset actuator 17 away from the casing 10 such that the safety switch is returned to its initial settings as illustrated in FIG. 2*a*. Electrical power can now be re-supplied to the machinery by depressing the handle 11 to the position as shown and described with reference to FIG. 2*b*.

Provision of the reset actuator 17 ensures that if the user is startled or electrocuted (for example), thereby increasing the pressure on the handle 11, power to the machinery cannot be restored without a deliberate action. This provides an additional safety measure, beyond the non-conducting state of the safety switch when the handle 11 is in the first or third operating zone.

It will be appreciated that the handle 11 and casing 10 may be of any suitable shape. For example, the handle 11 and casing 10 may be of a certain ergonomic design. The handle 11 may not be mounted within the casing 10, but may be attached to any suitable body.

Pressure applied to the handle 11 need not be applied by the hands of a user. For example, the handle 11 may be operated by the foot or feet of a user, or even by the mouth or chin of a user. Such a method of operation leaves both hands of the user free to use tools, equipment etc.

The safety switch may be used with a power supply and machinery or equipment powered by that power supply. The safety switch of the present invention may also be used in conjunction with other safety switches which may be used to control the power supplied to machinery within an enclosure as described above, so that a user may enter an enclosure and operate on machinery safely.

The springs and biasing members referred to above may be coil springs, leave springs or any suitable biasing element.

It will be appreciated that the above embodiment has been described by way of example only, and that the various modifications may be made thereto without departing from the invention as defined by the claims, which follow.

The use of electrical contacts is not essential. In some circumstances a variable power supply (as opposed to a simple on-off arrangement) may be desirable. Movement of the handle between the first operating zone and the second operating zone may be used to control a variable power supply to the machinery, for example to control the speed of operation of the machinery. In this case, movement of the handle may be used to control the resistance of a variable resistor, or any other apparatus suitable for varying the supply of electrical power to the machinery. In short, any electrical circuit components may be used to implement the desired supply of electrical power to the machinery. The circuit components may be, for example, electrical contacts, a variable resistor, etc. The electrical contacts may be arranged to open to prevent the switch from conducting electricity, and arranged to close to allow the switch to conduct electricity.

Most preferably, when the handle is moved from the second operating zone to the third operating zone, the electrical power to the machinery is switched off immediately, i.e. a simple on-off arrangement is employed. Such an arrangement ensures that should the user be startled and depress the handle to the third operating zone, the power supply to the machinery is cut-off immediately (as opposed to gradually), so that the time over which the startled user is exposed to operating machinery is minimised.

It will be appreciated that the handle need not be pivotably attached to the body. For example, the handle may be slidably mounted within the body, and moveable between the first, second and third operating zones. In the case where pivotable attachment of the handle to the body is not essential, the handle may be attached to the body in any suitable manner.

What is claimed is:

1. A safety switch comprising:

a body;

at least one electrical component for controlling conduction of electricity by the safety switch; and a handle pivotably attached to the body and pivotable about a pivot point, the handle being pivotable between a first operating zone, a second operating zone and a third operating zone, wherein:

the first operating zone corresponds to a situation where the handle is not depressed and the electrical component is arranged such that the safety switch cannot conduct electricity;

the second operating zone corresponds to a situation where the handle is depressed to a first extent and the electrical component is arranged such that the safety switch is able to conduct electricity; and the third operating zone corresponds to the situation where the handle is depressed to a further, second extent, and the electrical component is arranged such that the safety switch cannot conduct electricity, wherein the pivot point is moveable from a first position to a second position when the handle is depressed to the third operating zone, the second position of the pivot point being arranged such that the electrical component is arranged such that the safety switch cannot conduct electricity, irrespective of whether the handle is subsequently moved to second operating zones.

2. The safety switch of claim 1 further comprising a reset actuator which is arranged such that upon moving the handle to the third operating zone, the electrical component is maintained in an arrangement such that the safety switch cannot conduct electricity, until the reset actuator has been activated.

3. The safety switch of claim 2 wherein the reset actuator is arranged to move the pivot point from the second position to the first position.

4. The safety switch of claim 1 further comprising a first biasing member configured to maintain the pivot point in the first pivot point position when the pivot point is in the first pivot point position.

5. The safety switch of claim 1 further comprising a second biasing member configured to maintain the pivot point in the second pivot position when the pivot point is in the second pivot point position.

6. The safety switch of claim 1 further comprising a fulcrum extending from the handle such that upon moving the handle between the second operating zone and the third operating zone, the handle pivots about the fulcrum such that the pivot point moves from the first position to the second position.

7. A powered piece of equipment safety switch arranged to allow control of a supply of power to the equipment comprising:

a body;

at least one electrical component for controlling conduction of electricity by the safety switch; and a handle pivotably attached to the body and pivotable about a pivot point, the handle being pivotable between a first operating zone, a second operating zone, and a third operating zone, wherein:

the first operating zone corresponds to a situation where the handle is not depressed and the electrical component is arranged, such that the safety switch cannot conduct electricity;

the second operating zone corresponds to a situation where the handle is depressed to a first extent and the electrical component is arranged such that the safety switch is able to conduct electricity; and the third operating zone corresponds to the situation where the handle is depressed to a second extent and the electrical component is arranged such that the safety switch cannot conduct electricity, wherein the pivot point is moveable from a first position to a second position when the handle is depressed to the third operating zone, the second position of the pivot point being arranged such that the electrical component is arranged such that the safety switch cannot conduct electricity, irrespective of whether the handle is subsequently moved to the first or second operating zones.

8. The equipment safety switch of claim 7 further comprising a reset actuator arranged such that upon moving the handle to the third operating zone, the electrical component is maintained in an arrangement such that the safety switch cannot conduct electricity, until the reset actuator has been activated.

9. The equipment safety switch of claim 7 wherein the safety switch is arranged to allow the control of the supply of electrical power to the equipment.

10. A safety switch comprising:

a body;

at least one electrical component for controlling conduction of electricity by the safety switch; and a handle attached to the body and moveable between a first operating zone, a second operating zone and a third operating zone, wherein:

the first operating zone corresponds to a situation where the handle is not depressed and the electrical component is arranged such that the safety switch cannot conduct electricity;

the second operating zone corresponds to a situation where the handle is depressed to a first extent and the electrical component is arranged such that the safety switch is able to conduct electricity; and the third operating zone corresponds to the situation where the handle is depressed to a further, second extent, and the electrical component is arranged such that the safety switch cannot conduct electricity, wherein the safety switch further comprises a reset actuator which is arranged such that upon moving the handle to the third operating zone, the electrical component is maintained in an arrangement such that the safety switch cannot conduct electricity, until the reset actuator has been activated.

11. The safety switch of claim 10 wherein the handle is pivotably attached to the body and pivotable about a pivot point.

12. The safety switch of claim 11 wherein the pivot point is moveable from a first position to a second position when the handle is depressed to the third operating zone, the second position of the pivot point being arranged such that the electrical component is arranged such that the safety switch cannot conduct electricity, irrespective of whether the handle is subsequently moved to the first or second operating zones.

13. The safety switch of claim 12 wherein the reset actuator is arranged to move the pivot point from the second position to the first position.

14. The safety switch of claim 11 further comprising a fulcrum extending from the handle such that the electrical component is between the fulcrum and the pivot point.

15. A safety switch comprising:

a casing having an electrical contact assembly therein;

a handle attached to the casing and pivotable about a movable pivot, the handle configured to manipulate the electrical contact assembly such that the electrical contact assembly is conductive when a first grip pressure is applied to the handle and the electrical contact assembly is non-conductive when no grip pressure is applied to the handle and when a grip pressure greater than the first grip pressure is applied to the handle; and, a reset actuator configured to move the pivot only in one direction.

16. The safety switch of claim 15 further comprising a spring disposed between the handle and the casing and configured to bias the handle to a no grip pressure position.

17. The safety switch of claim 15 wherein the pivot is movable between a first position and a second position and the safety switch further comprises a biasing mechanism configured to maintain the pivot in a previous position relative to the casing.

18. The safety switch of claim 17 wherein the reset actuator is configured to move the pivot from the second position to the first position.

19. The safety switch of claim 17 wherein the biasing mechanism further comprises a first spring to maintain the pivot in the first position and another spring to maintain the pivot in the second position.

* * * * *